US006827239B2

(12) United States Patent
Lasserre et al.

(10) Patent No.: US 6,827,239 B2
(45) Date of Patent: Dec. 7, 2004

(54) DISPENSING HEAD FOR DISPENSING A PRODUCT

(75) Inventors: Pierr-André Lasserre, Coubron (FR); Marcel Sanchez, Aulnay-Sous-Bois (FR)

(73) Assignee: L'Oreal, Paris (FR)

( * ) Notice: Subject to any disclaimer, the term of this patent is extended or adjusted under 35 U.S.C. 154(b) by 155 days.

(21) Appl. No.: 10/224,432

(22) Filed: Aug. 21, 2002

(65) Prior Publication Data

US 2003/0071085 A1 Apr. 17, 2003

(30) Foreign Application Priority Data

Aug. 22, 2001 (FR) ..... 01 11003

(51) Int. Cl.[7] ..... B67D 5/32; B65D 83/00

(52) U.S. Cl. ..... 222/153.11; 222/402.21; 222/402.23; 222/521

(58) Field of Search ..... 222/153.11, 153.13, 222/153.14, 402.1, 402.12, 402.13, 402.21, 402.23, 523

(56) References Cited

U.S. PATENT DOCUMENTS

| | | | | |
|---|---|---|---|---|
| 2,766,913 A | * | 10/1956 | Wilshusen | 222/402.22 |
| 2,767,888 A | | 10/1956 | Soffer | |
| 3,233,788 A | | 2/1966 | Diamond | |
| 3,318,492 A | | 5/1967 | Haas | |
| 3,406,944 A | | 10/1968 | Barker | |
| 3,450,316 A | | 6/1969 | Barker | |
| 3,549,060 A | * | 12/1970 | Smylie | 222/513 |
| 3,675,823 A | | 7/1972 | Steiman | |
| 3,696,977 A | | 10/1972 | Davenport et al. | |
| 3,777,947 A | * | 12/1973 | Klema | 222/402.23 |

(List continued on next page.)

FOREIGN PATENT DOCUMENTS

| | | | |
|---|---|---|---|
| CH | 679 660 | 3/1992 | |
| EP | 0 031 123 | 7/1981 | |
| EP | 0 298 847 | 1/1989 | |
| FR | 2 251 7691 | 6/1975 | |
| FR | 2 253 970 | 7/1975 | |
| FR | 2 570 000 | 3/1986 | |
| FR | 2 635 085 | 2/1990 | |
| FR | 2 684 080 | 5/1993 | |
| WO | WO 9322212 | * 11/1993 | B65D/47/24 |

OTHER PUBLICATIONS

Co–pending application No. 09/986,028, Dispensing Head for Dispensing a Product, Pierre–André Lasserre, U.S. filing date: Nov. 7, 2001.

(List continued on next page.)

*Primary Examiner*—Gene Mancene
*Assistant Examiner*—Patrick Buechner
(74) *Attorney, Agent, or Firm*—Finnegan, Henderson, Farabow, Garrett and Dunner, LLP

(57) ABSTRACT

A dispensing head for dispensing a product from a receptacle associated with an actuatable dispensing element. The dispensing head comprises a first element defining a channel passing through the first element, and a second element. The first element may be configured to be coupled to the actuatable dispensing element. The first element may further define at least one inner outlet orifice. The channel may be configured to pass product from the actuatable dispensing element to the at least one inner outlet orifice. The second element may define at least one dispensing orifice. The second element may be configured to be displaced relative to the first element from a first position, where actuation of the actuatable dispensing element is prevented and the dispensing orifice is closed by the first element, to a second position, where actuation of the actuatable dispensing element is allowed and the at least one dispensing orifice is at least partly open and communicates with the at least one inner outlet orifice.

55 Claims, 3 Drawing Sheets

U.S. PATENT DOCUMENTS

| | | | | | |
|---|---|---|---|---|---|
| 3,901,410 | A | | 8/1975 | Schultz | |
| 4,008,834 | A | * | 2/1977 | Towns | 222/402.23 |
| 4,860,933 | A | | 8/1989 | Morane et al. | |
| 4,944,429 | A | | 7/1990 | Bishop et al. | |
| 5,031,800 | A | | 7/1991 | Brunet | |
| 5,305,930 | A | | 4/1994 | De Laforcade | |
| 5,335,823 | A | * | 8/1994 | Fuchs et al. | 222/36 |
| 5,370,313 | A | | 12/1994 | Beard | |
| 5,722,568 | A | | 3/1998 | Smith | |
| 6,059,151 | A | * | 5/2000 | Fuchs | 222/321.6 |
| 6,105,826 | A | * | 8/2000 | Oursin et al. | 222/153.06 |
| 6,170,720 | B1 | * | 1/2001 | Gnepper et al. | 222/481.5 |
| 6,439,440 | B1 | * | 8/2002 | Lasserre | 222/402.21 |

OTHER PUBLICATIONS

English language Derwent Abstract of CH 679 660, Mar. 31, 1992.

English language Derwent Abstract of FR 2 251 761, Jun. 13, 1975.

English language Derwent Abstract of FR 2 253 970, Jul. 4, 1975.

English language Derwent Abstract of FR 2 570 000, Mar. 14, 1986.

English language Derwent Abstract of FR 2 635 085, Feb. 9, 1990.

* cited by examiner

DISPENSING HEAD FOR DISPENSING A PRODUCT

The present invention relates to a dispensing head for dispensing a product such as a cosmetic product. For example, the dispensing head could be used for dispensing product from a receptacle containing the product in a pressurized state. Such a product may be in the form of a liquid or a foam, or have a more viscous consistency, such as in the form of a cream or a gel. The product could be chosen from a care product, a make-up product, a body-hygiene product, a hair-care product, and a sun-screen product.

The dispensing head could be part of a device including a valve, and the product may be pressurized by, for example, a liquefied or non-liquefied propellant gas. The gas may be packaged directly in contact with the product or separately via a piston or a pouch with flexible walls.

French Patent Application 2,635,085 describes a dispenser for dispensing a liquid from a container by a pumping action. A valve is positioned in the container. A dispensing head is included for actuating the valve. The liquid is dispensed via at least one dispensing orifice in the dispensing head. A cap is positioned over the dispensing head between uses. The problems posed by the configuration shown in French Patent Application 2,635,085 are many. For example, even when the cap is fully mounted on the device, the dispensing orifice of the dispensing head is not closed off in a leak-tight manner. Therefore, the dispensing orifice and the channel leading to the dispensing orifice tend to be subject to fouling, particularly when a product with a strong tendency to clog when drying is contained in the container. Such fouling of the dispensing orifice and channel may render the device unusable, particularly after a long period of non-use. Furthermore, the residual product in the channel and in the vicinity of the orifice is prone to degradation due at least partially to oxidation, and is prone to be unattractive in appearance.

Furthermore, the risk of untimely actuation of the dispensing element is increased, particularly if used with a valve having a short actuation stroke.

Moreover, in the field of aerosol type devices, it is also known either to produce a valve directly in the form of an end piece defining a channel, the free end of which is closed by a center piece in the rest position, or to equip a conventional valve with such an end piece. Devices of the aforementioned type are generally described in EP031123B1, French Application No. 2,684,080, U.S. Pat. Nos. 5,370,313, 3,696,977, EP298847, French Application No. 2,251,761, French Application No. 2,253,970, and U.S. Pat. No. 3,406,944. For some of these devices, the channel conveying the product is formed inside the center-post of the valve. For others, the channel conveying the product is formed around the center-post.

An actuating command, generally in the form of a force, breaks the seal between the center-post and the free edge of the end piece delimiting the dispensing orifice, thus at least partly opening the dispensing orifice. When the end piece acts as a valve, the opening of the dispensing orifice enables the product to be dispensed.

When the end piece surmounts a conventional valve, the actuating command causes, in a simultaneous or almost simultaneous manner, the opening of the dispensing orifice and the opening of the valve. Similarly, the dispensing orifice may be returned to its closed position by elastic return when the force actuating the valve ceases. The elastic return may be caused by the effect of pressure from the product, or by a return force generated by a spring associated with the valve, or by an auxiliary spring.

In general, such configurations enable the conveying channel, located upstream of the dispensing orifice, to be protected from the external environment, thus avoiding the problems of residual product coagulation or oxidation.

On the other hand, the device described in French Application No. 2,635,085 does not contain structure to prevent accidental actuation of the valve.

Furthermore, such a design involves a body movement which is not always user friendly and may make dispensing difficult. For example, it may be difficult to dispense if a user desires to actuate the valve and collect the dispensed product with the same finger. Moreover, it may be difficult to obtain the desired sealing, especially near the dispensing orifice, without making it very difficult to actuate the valve. Finally, the cost of manufacturing such a device may be rather high, which is often incompatible with a desire to mass produce the device.

In U.S. Pat. No. 3,450,316, the valve stem itself acts as a center-post. An external outer element including a dispensing orifice is screwed onto the valve stem so as to displace from a first position in which the dispensing orifice is opened to a second position in which the dispensing orifice is blocked. The drawback of such a design is that it cannot be used with a standard valve stem. Furthermore, it is may be very difficult to mount the external outer element. In addition, for valves with a short actuating stroke, it may be difficult to prevent untimely actuation of the valve, and to ensure proper sealing. This is because the free end of the valve stem itself provides the sealed closure of the dispensing orifice when the external element is in the second position. As a result, because the external element and the valve stem are directly coupled, the slightest pressure exerted by the external element on the valve stem risks actuation of the valve. A structure of the same type is described in U.S. Pat. No. 3,901,410.

One of the aspects of the present invention is to provide a device for dispensing a product, such as a cosmetic product, wherein the device optionally remedies at least one of the above-mentioned drawbacks.

In particular, a need exists for a device with a low risk of plugging and clogging the dispensing orifice and/or the channel.

A need further exists to supply a device which may be manufactured and assembled economically and which is simple to use.

Further, it may be desirable to provide a device with a low risk of unexpected actuation of the dispensing element.

It should be understood that the invention could be practiced without satisfying one or more of the needs described above and/or without fulfilling one or more of the aspects, objects and/or advantages described herein. In addition, it should be understood that the embodiments described herein are merely exemplary.

As embodied and broadly described herein, one aspect of the invention includes a dispensing head for dispensing a product from a receptacle associated with an actuatable dispensing element. The dispensing head comprises a first element defining a channel passing through the first element, and a second element. The first element may be configured to be coupled to the actuatable dispensing element. The first element may further define at least one inner outlet orifice. The channel may be configured to pass product from the actuatable dispensing element to the at least one inner outlet orifice. The second element may define at least one dispensing orifice. The second element may be configured to be displaced relative to the first element from a first position, where actuation of the actuatable dispensing element is prevented and the dispensing orifice is closed by the first element, to a second position, where actuation of the actuatable dispensing element is allowed and the at least one dispensing orifice is at least partly open and communicates with the at least one inner outlet orifice.

Another aspect relates to a dispensing device comprising a receptacle, a product contained in the receptacle, an actuatable dispensing element associated with the receptacle, and a dispensing head. In some embodiments, the actuatable dispensing element may be an actuatable valve stem of a valve associated with the receptacle. Many other forms of actuatable dispensing elements are also possible. For example, the actuatable dispensing element could be an actuatable portion of a pump associated with the reservoir.

With at least one embodiment, by way of example only, the risk of unexpected actuation of the dispensing element may be minimized and the entire portion of the dispensing head located upstream of the dispensing orifice may be sheltered from the outside air when the device is in a storage position, thus minimizing risk of coagulation of the residual product and clogging of the dispensing head.

According to at least one optional aspect of the invention, and unlike some conventional configurations referenced above (such as those where the dispensing orifice is coupled directly to the valve stem), the first element may be a separate element from the dispensing element (e.g., valve stem) and may be inserted between the dispensing element and the second element. The first element may therefore act as a buffer between the dispensing element and the second element, making it possible to ensure proper sealing when the dispensing orifice is closed, and to minimize the risk of untimely actuation of the dispensing element.

In one embodiment, the dispensing head is compatible with a standard valve stem.

Some embodiments of the dispensing head may have an aesthetic appearance similar to dispensing heads used with tube-shaped containers. This feature may be desired from a marketing perspective, particularly when the product to be packaged is in the form of a care cream or a gel that is conventionally packaged in a tube.

According to an embodiment, means may be provided for, at least when the second element is in the second position, ensuring a substantial seal between the first element and the second element so that all of the product exiting from the inner outlet orifice(s) is channeled towards the dispensing orifice. In yet another embodiment, these means also provide a seal when the second element is in the first position. This may render it possible to prevent the residual product residing near the inner outlet orifice from flowing between the first element and the second element, in the direction of the dispensing element, thus soiling the device. In one embodiment, the means may consist of an annular lip, a free edge of which, at least when the second element is in the second position, is applied in a substantially sealed manner against an inner annular surface of the second element.

The device may comprise means which, when the second element is in the first position relative to the first element, are elastically stressed between the first and second elements. Such elastic stress may cause pressing between the first element and the second element so as to provide sufficiently sealed closure of the dispensing orifice with minimal risk of dispensing element actuation. For this purpose, the annular lip may be configured to be substantially flexible.

The sealing means may also act as elastic means, thereby simplifying the overall structure of the device. In at least one embodiment, the annular lip may have its free edge turned in a direction away from the dispensing element. Thus, when the second element is in the first position, the free edge may press slightly elastically against the inner surface of an end wall of the second element, delimiting the dispensing orifice, the free edge being applied in a sealed manner against the inner surface of a side wall of the second element when the second element is in the second position.

In at least one embodiment wherein the dispensing element is a valve, actuation of the valve may result from a command exerted on the second element when the second element is in the second position. To this end, the outer surface of the second element may comprise reliefs, such as bosses or hollow portions, allowing the exertion of an actuation force (or pressure) at the appropriate place. According to one embodiment, the movement of actuating the valve is a movement which is distinct from that enabling the second element to displace from the first position (e.g., storage position) to the second position (e.g., dispensing position). Thus the movement intended to make the dispensing head displace from the storage position to the dispensing position may be disassociated from the movement of actuating the valve. In such an embodiment, two separate commands (e.g., movements) may be implemented: a first command to move the dispensing head into the dispensing position, and a second command to actuate the valve.

According to at least one embodiment, displacement of the second element from the first position to the second position results from a movement of the second element relative to the first element in a direction which is different from the actuation movement of the actuatable dispensing element. Thus the risks of untimely actuation of the valve may be minimized, particularly when the dispensing head displaces from the storage position to the dispensing position. In such an embodiment, the displacement of the second element from the first position to the second position may be caused by movement of the second element relative to the first element along a longitudinal axis of the first element. The movement of actuating the actuatable dispensing element may be a movement transverse to the longitudinal axis. Such a configuration corresponds to one in which a tilt valve is used.

Alternatively, the displacement of the second element from the first position to the second position is caused by a movement of the second element relative to the first element in a first direction along a longitudinal axis of the first element. The actuation movement of the actuatable dispensing element may be a movement along the longitudinal axis of the first element in a second direction opposite the first direction. Such a configuration corresponds to one in which a push-in valve is used.

According to one embodiment, the coupling between the first element and the second element may be such that the second position of the second element relative to the first element is a "stable" position where the second position may be maintained even when the force causing displacement from the first position to the second position ceases. Such a coupling of the first element may include a screwing or unscrewing movement. This is because such a coupling may permit sealing to be achieved upon closing the dispensing orifice while minimizing the risk of untimely actuation, in particular when, after use, the user makes the dispensing head displace from the dispensing position to the storage position.

According to one particular embodiment, displacement of the second element from the first position to the second position is caused by a rotation, about the longitudinal axis of the first element, of the second element by approximately 360° relative to the first element.

According to another embodiment, the first element includes threading configured to interact with a corresponding threading on the second element. The threading on the first element may be provided on the outer surface of the first element. The threading on the second element may be provided on the inner surface of the second element. In certain embodiments, the threading of the first element is positioned on a portion of the first element having a larger cross-section than the cross-section of a free end of the first element.

In another aspect, the inner outlet orifice(s) have an axis which is not parallel to an axis of the dispensing orifice. Thus, the dispensing orifice may be oriented along a longitudinal axis of the first element, and the inner outlet orifice(s) may be oriented transversely to the longitudinal axis of the first element.

In another aspect, a channel passes axially through the first element.

In yet another aspect of the invention, the dispensing head comprises a mounting element configured to be removably fixed to the receptacle. In particular, the mounting element may be a mounting band. In one aspect, the first element is rotatably fixed relative to the mounting element. This may be particularly useful when the relative movement between the first and second elements is a screwing/unscrewing movement.

The mounting band may be mounted securely on the receptacle, particularly by clamping snap-fitting. Alternatively, it may be screwed onto the receptacle. A variety of other known mounting methods are also acceptable.

The first element may be rotatably fixed relative to the mounting element by at least one tooth (or notch) on one of the first element and the mounting element configured to engage a corresponding number of grooves on the other of the first element and the mounting band. Any number of teeth may be provided. It may be desirable to have a larger number of teeth in order to ease the operation of mounting the dispensing head. For example, the number of teeth may range from two to six, or from two to four. As used herein, a "tooth" is defined as any type of projection that is configured to engage a groove and/or another projection to prevent rotational movement between two members.

In a further aspect of the invention, the second element comprises an edge. In an exemplary embodiment, the edge of the second element is an annular edge. Other shapes are also contemplated. When the second element is in the first position, the edge is substantially in contact with the mounting element, thereby preventing actuation of the dispensing element. The word "substantially" reflects that the play that exists between the annular edge of the second (outer) element and the mounting element is smaller than the travel associated with actuation of the dispensing element. Such play, when the dispensing element is a valve, may be of the order of about 0.5 mm. It is to be understood that the amount of play may be smaller or greater, however. In one embodiment, the annular edge may be positioned away from an end wall in which the dispensing orifice is made.

In a further aspect, means are provided for preventing detachment of the second element from the first element when the dispensing head is mounted on the receptacle. In one embodiment, the means comprise at least one axial stop. The axial stop may be positioned on one of an outer surface of the first element and an inner surface of the second element. In one embodiment, the axial stop comprises an outward annular projection on an outer surface of the first element and an inwardly projecting flange on an inner surface of the second element.

In another aspect, the first element may comprise a member, especially in the form of a continuous or discontinuous flange, which, in cooperation with a corresponding portion of the mounting element (e.g., mounting band), prevents the dispensing head from detaching from the mounting element. Furthermore, this annular flange, during actuation of the dispensing element by tilting, may engage with the corresponding portion of the mounting element, thereby acting as a lever arm. In one embodiment, the annular flange defines the teeth (or notches) for rotatably coupling the mounting element and the first element.

The device according to the invention may be used for packaging and dispensing of a wide variety of products from a receptacle. For example, the device could be used to dispense a cosmetic product, such as a care, make-up, body-hygiene, hair-care, or sun-screen product.

Aside from the arrangements set forth above, the invention may comprise any number of other arrangements. The accompanying drawings are included to provide a further understanding of the invention and are incorporated in and constitute a part of this specification. The drawings illustrate exemplary embodiments of the invention and together with the description, serve to explain certain principles. In the drawings, FIG. 1 is a side view of an exemplary embodiment of a device according to the present invention;

Reference will now be made in detail to exemplary embodiments of the invention, an example of which is illustrated in the accompanying drawings. Wherever. possible, the same reference numbers are used in the drawings and the description to refer to the same or like parts.

Figure 1:
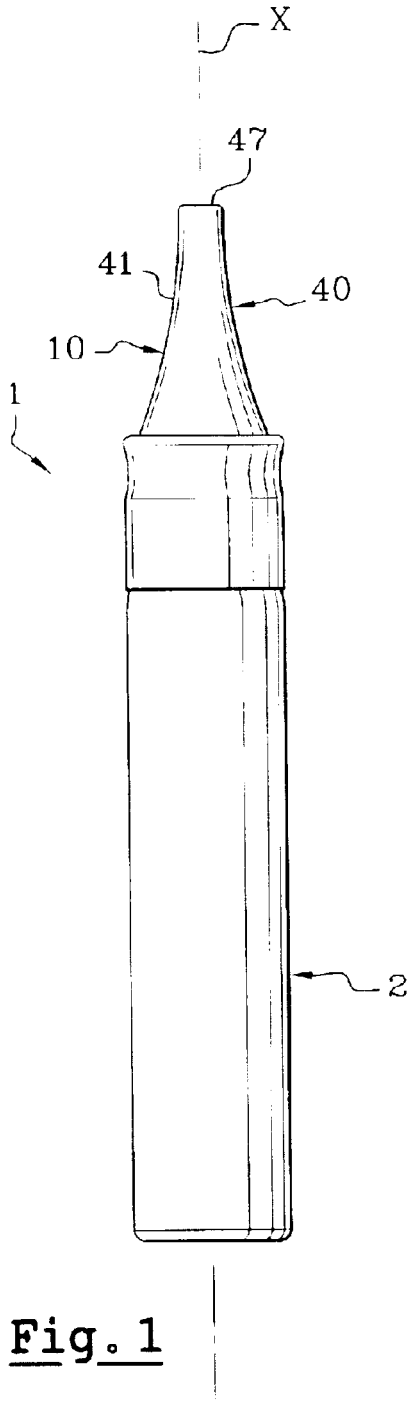
Figure 2:
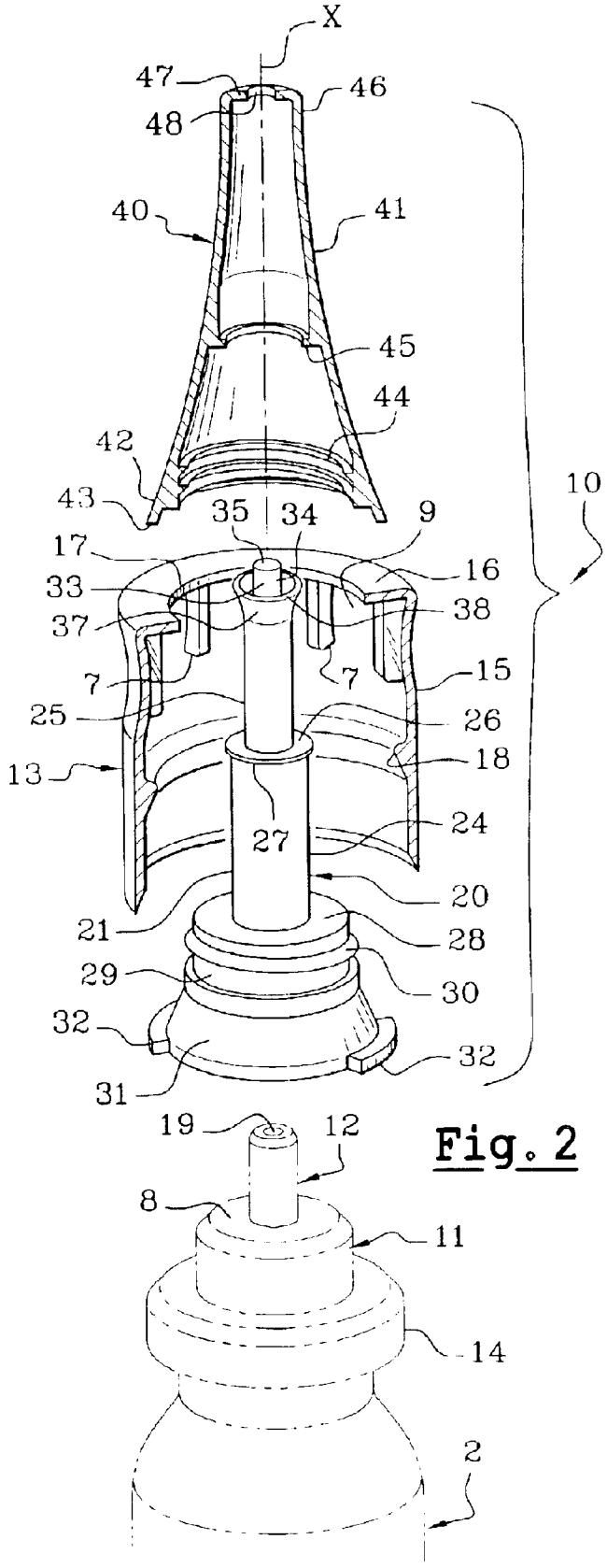
FIG. 2 is an exploded view of the top portion of the device of FIG. 1 with certain components shown in cross-section.

As shown in the embodiment of FIGS. 1, 2, and 3A–3D, a dispensing device 1 comprises a receptacle (e.g., container) 2 containing a product and a gas capable of pressurizing the product. The receptacle 2 may be made from any acceptable material such as aluminum or tin plate. A valve 11 of the tilting type is attached to the top of receptacle. The valve 11 comprises a dispensing element in the form of a valve stem 12 emerging outside the valve body 8. The valve may be configured to be actuated by tilting the valve stem 12 and/or pressing the valve stem axially. An axial channel 19 passes through the valve stem 12.

The receptacle 2 may be equipped with a dispensing head 10 for the actuation of the valve 11 and the dispensing of the product under pressure. The dispensing head 10 may comprise a mounting element including a mounting band 13 mounted by snap-fitting on a crimping bead or projection 14 of the valve 11. The mounting band 13 may comprise a cylindrical skirt 15, one end of which is open and the other end of which may comprise an annular rim 16 delimiting an opening 17. The inner surface of the skirt 15 may be provided with an inner projection (e.g., bead) 18 for the snap-fitting of the mounting band 13 over the crimping projection 14 of the valve.

The dispensing head 10 may further comprise a first element 20. The first element 20 (e.g., inner element) comprises a tubular member 21, the first end 22 of which may be removably fixed onto the valve stem 12 so as to ensure communication between the axial channel 23 traversing the first element 20 and the axial channel 19 traversing the valve stem 12. The axial channel 23 and axial channel 19 are positioned along the longitudinal axis (labeled X) of the first element.

The tubular member 21 comprises a first portion 24 adjacent to the first end 22. The first portion 24 is separated from a second portion 25 by a shoulder 26 terminated at its periphery by an annular bead 27. In the embodiment shown, the second portion 25 has a smaller cross section than the first portion 24.

Near the first end 22, the tubular member 21 may be connected to a transverse annular wall 28. The peripheral edge of the annular wall 28 may be connected to a lateral skirt 29. The lateral skirt 29 comprises threading 30 on its outer surface.

At its end away from the transverse wall 28, the lateral skirt 29 is connected to a frustoconical skirt portion 31. The skirt portion progressively increases in cross-section as the distance from threading 30 along the longitudinal axis (X) increases. The skirt portion is terminated by a discontinuous annular flange, the external diameter of which is greater than the diameter of the opening 17 made in the mounting element (e.g., band) 13.

Figure 3A:
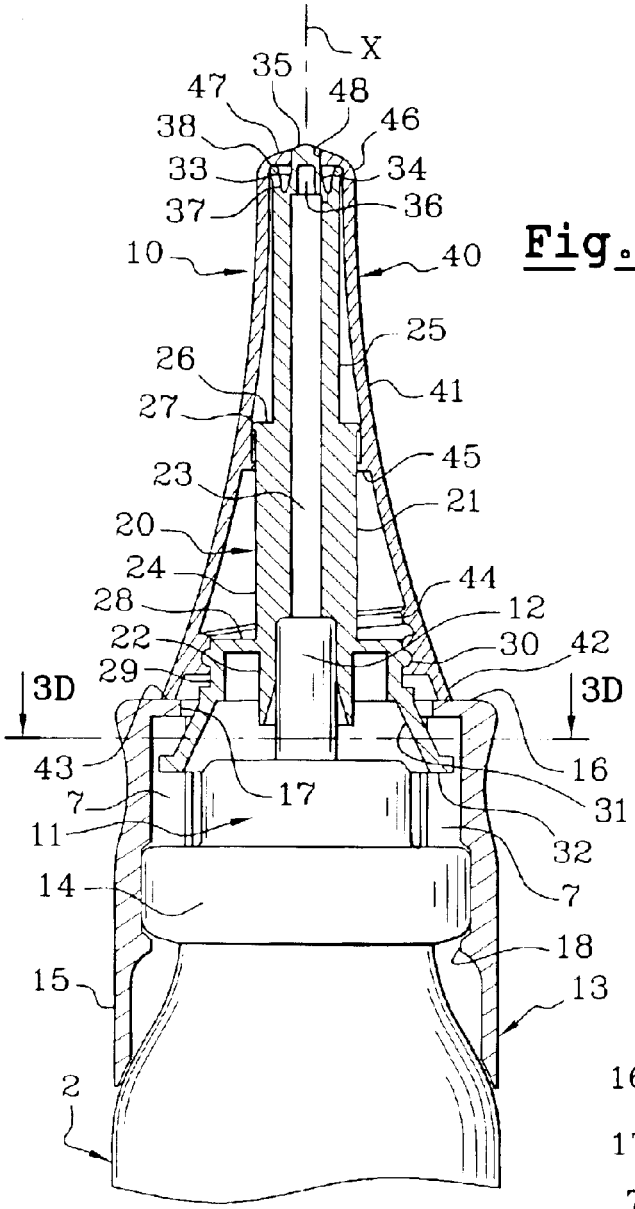
FIG. 3A is a cross-sectional side view of the top portion of the device of FIG. 1, with a dispensing head in a storage position.
Figure 3B:
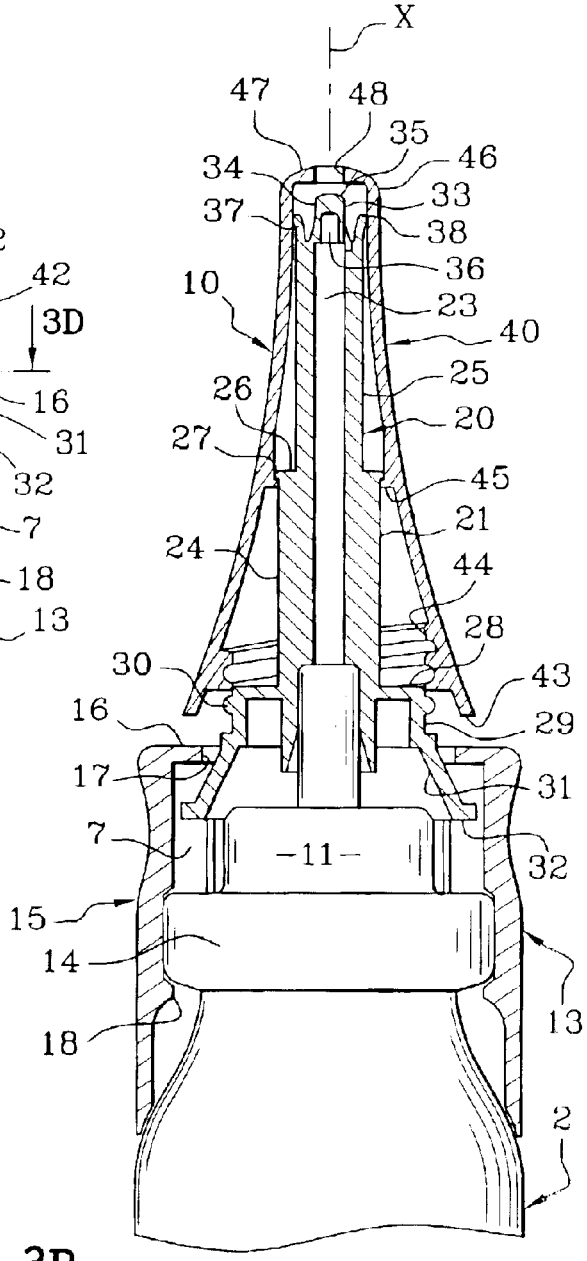
FIG. 3B is a cross-sectional side view of the top portion of the device of FIG. 1, with the dispensing head in the dispensing position.

The discontinuous flange may comprise two diametrically opposed portions forming teeth or notches 32 intended to be inserted into grooves 9 of the mounting element 13. The grooves 9 may be formed between the ribs 7 spaced regularly over the inner surface of the lateral skirt 15 of the mounting element 13. The engagement of the teeth 32 and grooves 9 serve to rotatably fix the first element 20 of the dispensing head 10 with respect to the mounting element 13. This engagement of the grooves 9 of the mounting element 13 with the notches 32 of the inner element 20 is illustrated in FIG. 3D.

At its end 33 away from the end 22, the tubular member 21 is terminated by a portion of small cross section 34 closed by end wall 35. Near the end wall 35, the channel 23 of the first element opens out radially via at least one inner outlet orifice 36. The portion of small cross section 34 is bordered by an annular lip 37, one end of which is connected to the inner element 20, and the other end of which forms a free edge 38 turned upwards.

The dispensing head 10 may also comprise a second element 40. The second element 40 is configured to surround portions of the first element 20.

Second element 40 may comprise a lateral skirt 41. In the embodiment shown, the cross-section of the lateral skirt 41 increases progressively in the direction of an open end 42 which is terminated by a free edge 43. Near the open end 42 of the lateral skirt 41, the inner surface of the lateral skirt 41 comprises a screw thread 44 capable of cooperating with the screw thread 30 provided on the outer surface of the inner element 20.

Substantially at mid-height, the inner surface of the lateral skirt 41 forms an annular rim 45 capable of abutting the bead 27 of the first element 20. The abutment of the annular rim 45 to the bead 27 assists in preventing the second element 40 from becoming detached from the inner element 20, as will be described in greater detail below.

At its end 46 away from the open end 43, the lateral skirt is closed by a transverse wall 47 pierced at its center by an axial orifice 48. The axial orifice 48 has a diameter which is slightly greater than the external diameter of the portion of small cross section 34 of the inner element 20. The portion 34 of the first element 20 has a cross section which increases slightly in the direction away from the end wall 35.

The device shown in FIGS. 1, 2, and 3A–3D may be used as follows. First, the first (inner) element 20 is inserted by its end 33 inside the mounting band 13 via the opening 17 of the mounting band. During insertion of the first element into the mounting band, it is preferable to arrange the notches (teeth) 32 between two ribs 7 of the mounting band 13.

Next, the first (inner) element 20, equipped with the mounting band 13, is inserted by its end 33 inside the second (outer) element 40 until the bead 27 passes past the annular flange 45. The bead 27 may be displaced past the annular flange by slight elastic deformation.

The insertion of the first element 20 continues until the thread 44 of the second element 40 engages with the thread 30 of the first element 20.

The second element 40 is then screwed onto the first element 20. Once this is done, the portion 34 of small cross section of the first element 20 is engaged in a sealed manner inside the orifice 48 of the second element 40, as shown in FIG. 3A. The portion 34 of small cross section may have a cross section which increases slightly in the direction of the valve stem so as to promote sealing upon closure. The free edge 38 of the lip 37 presses slightly elastically against the inner surface of the end wall 47. The free edge 43 of the lateral skirt 41 is substantially in contact with the transverse annular wall 16 of the mounting band 13.

Next, the mounting band 13 may be mounted onto the receptacle by attaching it to the crimping bead 14 of the valve 11, while taking care to insert the valve stem 12 inside the lower end 22 of the tubular element 21.

In the mounted position, illustrated in FIG. 3A, the annular edge 43 of the second element 40 is in abutment against the transverse wall 16 of the mounting band 13. The dispensing orifice 48 is blocked in a sealed manner by the portion 34 of small cross section of the first element 20. In the position shown in FIG. 3A, any movement (insertion or lateral tilting) of the second element 40 is prevented, therefore preventing actuation of valve 11.

In order to actuate the valve 11 to dispense a dose of product, the user unscrews the second element 40 from the first element 20, until the flange 45 of the second element 40 is in abutment against the bead 27 of the first element. In this position, shown in FIG. 3B, the free edge 43 of the lateral skirt 41 of the outer element 40 is at some distance from the mounting band 13. The portion 34 of small cross-section of the inner element 20 is no longer engaged with the dispensing orifice 48, which is therefore detached. The free edge 38 of the annular lip 37 is applied in a sealed manner against the inner surface of the lateral skirt 41 of the outer element 40.

Figure 3C:
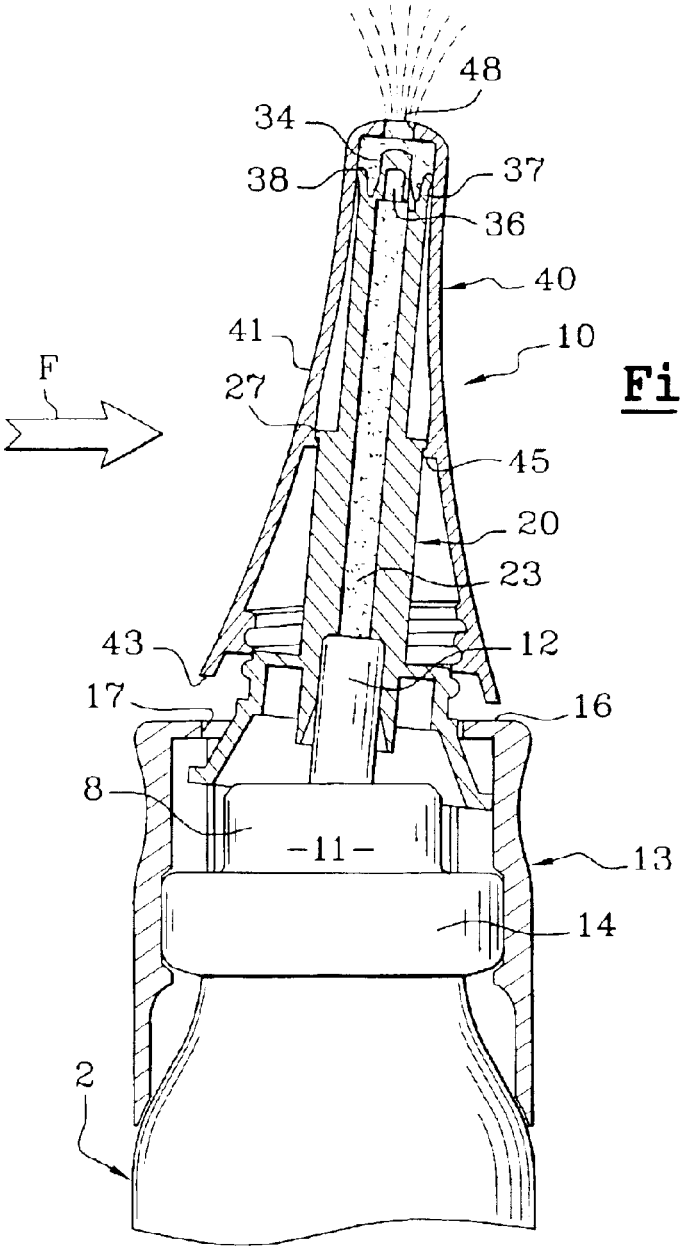
FIG. 3C is a cross-sectional side view of the top portion of the device of FIG. 1, with the dispensing element in an actuated position.
Figure 3D:
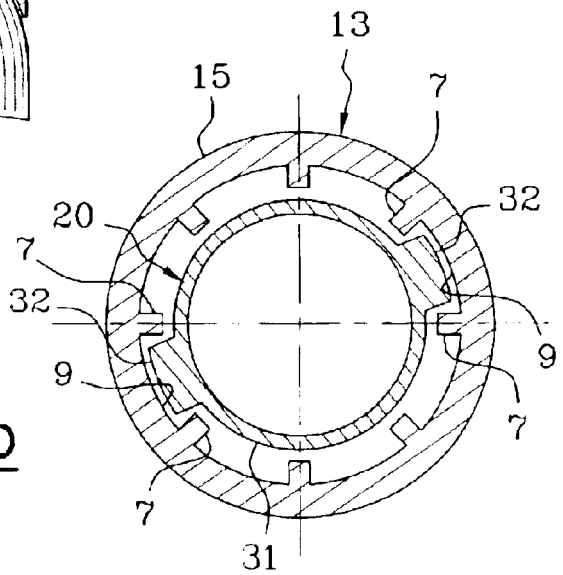
FIG. 3D is a cross-sectional view of the device taken along line 3D—3D of FIG. 3A.

To actuate the valve, as illustrated in FIG. 3C, a user typically places the dispensing orifice 48 so that it bears on the surface to be treated (e.g., the skin and/or hair) and displaces the device relative to the surface. This imparts a lateral force F on the outer surface of the lateral skirt 41 of the second (outer) element 40. The pressure exerted on the outer element 40 causes the valve stem 12 to tilt (or rock), thereby opening the valve and causing the release of the product from the receptacle. The product exits the valve stem 12 via the channel 19 of the valve stem 12, the channel 23 of the first element 20, the inner outlet orifice 36, and the dispensing orifice 48. When the pressure ceases on the second element 40, the valve may be automatically closed under the return force of a suitable spring placed inside the valve body 8.

After use, the user may screw the second element back onto the first element so that the dispensing head 10 returns to the configuration shown in FIG. 3A. The user may screw the second element back onto the first element without generating a force likely to cause actuation of the valve.

The invention is not limited to exemplary embodiments described above. For example, the invention is not limited to dispensing a cosmetic product, but also may be used for other substances, such as dermatological or pharmaceutical products.

The device and dispensing head also may have shapes and sizes other than described above.

It will be apparent to those skilled in the art that various modifications and variations can be made to the structure. Thus, it should be understood that the invention is not limited to the examples discussed in the specification. Rather, the present invention is intended to cover modifications and variations.

What is claimed is:

1. A dispensing head for dispensing a product from a receptacle associated with an actuatable dispensing element, the dispensing head comprising:

a first element defining a channel passing through the first element, the first element being configured to be coupled to the actuatable dispensing element, the first element further defining at least one inner outlet orifice, the channel being configured to pass product from the actuatable dispensing element to the at least one inner outlet orifice; and a second element defining at least one dispensing orifice, the second element being configured to be displaced relative to the first element from a first position, where actuation of the actuatable dispensing element is prevented and the dispensing orifice is closed by the first element, to a second position, where actuation of the actuatable dispensing element is allowed and the at least one dispensing orifice is at least partly open and communicates with the at least one inner outlet orifice;

wherein the dispensing head is configured so that actuation of the actuable dispersing element results from a movements of the second element when the second element is in the second position.

2. The dispensing head of claim 1, wherein displacement of the second element from the first position to the second position results from movement of the second element relative to the first element in a direction which is different from actuation movement of the actuatable dispensing element.

3. The dispensing head of claim 2, wherein the displacement of the second element from the first position to the second position is caused by a movement of the second element relative to the first element along a longitudinal axis of the first element, and wherein the movement of actuating the actuatable dispensing element is a movement transverse to the longitudinal axis.

4. The dispensing head of claim 3, wherein the movement of the second element relative to the first element comprises at least one of a screwing movement and an unscrewing movement.

5. The dispensing head of claim 4, wherein the displacement of the second element from the first position to the second position is caused by a rotation, about the longitudinal axis of the first element, of the second element by approximately 360° relative to the first element.

6. The dispensing head of claim 2, wherein the displacement of the second element from the first position to the second position is caused by a movement of the second element relative to the first element in a first direction along a longitudinal axis of the first element, and wherein the actuation movement of the actuatable dispensing element is a movement along the longitudinal axis of the first element in a second direction opposite the first direction.

7. The dispensing head of claim 6, wherein the movement of the second element relative to the first element comprises at least one of a screwing movement and an unscrewing movement.

8. The dispensing head of claim 7, wherein the displacement of the second element from the first position to the second position is caused by a rotation, about the longitudinal axis of the first element, of the second element by approximately 360° relative to the first element.

9. The dispensing head of claim 1, wherein the second element has a frusto-conical shape.

10. The dispensing head of claim 1, wherein the channel passes axially through the first element.

11. The dispensing head of claim 1, wherein the first element is configured to be removably coupled to the actuatable dispensing element.

12. A dispensing head for dispensing a product from a receptacle associated with an actuatable dispensing element, the dispensing head comprising:

a first element defining a channel passing through the first element, the first element being configured to be coupled to the actuatable dispensing element, the first element further defining at least one inner outlet orifice, the channel being configured to pass product from the actuatable dispensing element to the at least one inner outlet orifice; and a second element defining at least one dispensing orifice, the second element being configured to be displaced relative to the first element from a first position, where actuation of the actuatable dispensing element is prevented and the dispensing orifice is closed by the first element, to a second position, where actuation of the actuatable dispensing element is allowed and the at least one dispensing orifice is at least partly open and communicates with the at least one inner outlet orifice;

wherein the first element further comprises threading configured the interact with a corresponding threading on the second element.

13. The dispensing head of claim 12, wherein the threading on the first element is provided on the outer surface of the first element, and further wherein the threading on the second element is provided on the inner surface of the second element.

14. The dispensing head of claim 12, wherein the threading of the first element is positioned on a portion of the first element having a larger cross-section than the cross-section of a free end of the first element.

15. The dispensing head of claim 12, wherein the threading on the first and second elements permits the displacement of the first element relative to the second element.

16. A dispensing head for dispensing a product from a receptacle associated with an actuatable dispensing element, the dispensing head comprising:

a first element defining a channel passing through the first element, the first element being configured to be coupled to the actuatable dispensing element, the first element further defining at least one inner outlet orifice, the channel being configured to pass product from the actuatable dispensing element to the at least one inner outlet orifice; and a second element defining at least one dispensing orifice, the second element being configured to be displaced relative to the first element from a first position, where actuation of the actuatable dispensing element is prevented and the dispensing orifice is closed by the first element, to a second position, where actuation of the actuatable dispensing element is allowed and the at least one dispensing orifice is at least partly open and communicates with the at least one inner outlet orifice;

wherein the inner outlet orifice has an axis which is not parallel to an axis of the dispensing orifice, and wherein the at least one dispensing orifice is oriented along a longitudinal axis of the first element, and the at least one inner outlet orifice is oriented transversely to the longitudinal axis of the first element.

17. A dispensing head for dispensing a product from a receptacle associated with an actuatable dispensing element, the dispensing head comprising:

a first element defining a channel passing through the first element, the first element being configured to be coupled to the actuatable dispensing element, the first element further defining at least one inner outlet orifice, the channel being configured to pass product from the actuatable dispensing element to the at least one inner outlet orifice;

a second element defining at least one dispensing orifice, the second element being configured to be displaced relative to the first element from a first position, where actuation of the actuatable dispensing element is prevented and the dispensing orifice is closed by the first element, to a second position, where actuation of the actuatable dispensing element is allowed and the at least one dispensing orifice is at least partly open and communicates with the at least one inner outlet orifice; and a mounting element configured to be fixed to the receptacle;

wherein one of the first element and the mounting element comprises at least one tooth configured to engage at least one groove on the other of the first element and the mounting element so as to rotatably fix the first element relative to the mounting element.

18. The dispensing head of claim 17, wherein the second element comprises an edge substantially in contact with the mounting element when the second element is in the first position on the first element, so as to prevent actuation of the dispensing element.

19. The dispensing head of claim 18, wherein the edge of the second element is an annular edge.

20. The dispensing head of claim 19, wherein the annular edge of the second element is substantially in contact with an annular edge of the mounting element when the second element is in the first position.

21. A dispensing head for dispensing a product from a receptacle associated with an actuatable dispensing element, the dispensing head comprising:

a first element defining a channel passing through the first element, the first element being configured to be coupled to the actuatable dispensing element, the first element further defining at least one inner outlet orifice, the channel being configured to pass product from the actuatable dispensing element to the at least one inner outlet orifice;

a second element defining at least one dispensing orifice, the second element being configured to be displaced relative to the first element from a first position, where actuation of the actuatable dispensing element is prevented and the dispensing orifice is closed by the first element, to a second position, where actuation of the actuatable dispensing element is allowed and the at least one dispensing orifice is at least partly open and communicates with the at least one inner outlet orifice; and means for preventing detachment of the second element from the first element when the dispensing head is mounted on the receptacle.

22. The dispensing head of claim 21, wherein the means for preventing detachment comprises an axial stop positioned on at least one of an outer surface of the first element and an inner surface of the second element.

23. The dispensing head of claim 22, wherein the axial stop comprises an outward annular projection on an outer surface of the first element and an inwardly projecting flange on the inner surface of the second element.

24. A dispensing head for dispensing a product from a receptacle associated with an actuatable dispensing element, the dispensing head comprising:

a first element defining a channel passing through the first element, the first element being configured to be coupled to the actuatable dispensing element, the first element further defining at least one inner outlet orifice, the channel being configured to pass product from the actuatable dispensing element to the at least one inner outlet orifice;

a second element defining at least one dispensing orifice, the second element being configured to be displaced relative to the first element from a first position, where actuation of the actuatable dispensing element is prevented and the dispensing orifice is closed by the first element, to a second position, where actuation of the actuatable dispensing element is allowed and the at least one dispensing orifice is at least partly open and communicates with the at least one inner outlet orifice; and means for sealing between the first element and the second element, at least when the second element is in the second position, so as to ensure that all the product exiting from the at least one inner outlet orifice is channeled towards the dispensing orifice.

25. The dispensing head of claim 24, wherein the means for sealing comprises an annular lip having a free edge which, at least when the second element is in the second position, is applied in a sealed manner against an inner annular surface of the second element.

26. The dispensing head of claim 25, wherein the annular lip is elastic.

27. The dispensing head of claim 25, wherein the annular lip is elastically stressed between the first element and the second element when the second element is in the first position.

28. The dispensing head of claim 25, wherein when the second element is in the first position, the free edge bears elastically against the inner surface of an end wall of the second element delimiting said dispensing orifice, said free edge being applied in a sealed manner against the inner surface of a side wall of the second element when the second element is in the second position.

29. A dispensing device comprising:

a receptacle;

a product contained in the receptacle;

an actuatable dispensing element associated with the receptacle; and a dispensing head comprising:

a first element defining a channel passing through the first element, the first element being configured to be coupled to the actuatable dispensing element, the first element further defining at least one inner outlet orifice, the channel being configured to pass product from the actuatable dispensing element to the at least one inner outlet orifice; and a second element defining at least one dispensing orifice, the second element being configured to be displaced relative to the first element from a first position, where actuation of the actuatable dispensing element is prevented and the dispensing orifice is closed by the first element, to a second position, where actuation of the actuatable dispensing element is allowed and the at least one dispensing orifice is at least partly open and communicates with the at least one inner outlet orifice;

wherein the product contained in the receptacle is pressurized, and wherein the valve is a tilt-type valve configured to be actuated in response to a force oriented transverse to a longitudinal axis of the valve.

30. A dispensing device comprising:

a receptacle;

a product contained in the receptacle;

an actuatable dispensing element associated with the receptacle; and a dispensing head comprising:

a first element defining a channel passing through the first element, the first element being configured to be coupled to the actuatable dispensing element, the first element further defining at least one inner outlet orifice, the channel being configured to pass product from the actuatable dispensing element to the at least one inner outlet orifice; and a second element defining at least one dispensing orifice, the second element being configured to be displaced relative to the first element from a first position, where actuation of the actuatable dispensing element is prevented and the dispensing orifice is closed by the first element, to a second position, where actuation of the actuatable dispensing element is allowed and the at least one dispensing orifice is at least partly open and communicates with the at least one inner outlet; and a mounting element mounting the dispensing head to the receptacle so that rotation of the first element is restricted.

31. The dispensing device of claim 30, wherein the mounting element is fixedly mounted to the receptacle.

32. The dispensing device of claim 30, wherein the product comprises a cosmetic product.

33. The dispensing device of claim 32, wherein the cosmetic product is chosen from care products, make-up products, body-hygiene products, hair-care products, and sun-screen products.

34. A dispensing head for dispensing a product from a receptacle associated with an actuatable dispensing element, the dispensing head comprising:

a first element defining a channel passing through the first element, the first element further defining at least one inner outlet orifice, located so as to be spaced at a distance from the actuatable dispensing element, the channel being configured to pass product from the actuatable dispensing element to the at least one inner outlet orifice; and a second element defining at least one dispensing orifice, the second element being configured to be displaced relative to the first element from a first position, where actuation of the actuatable dispensing element is prevented and the dispensing orifice is closed by the first element, to a second position, where actuation of the actuatable dispensing element is allowed and the at least one dispensing orifice is at least partly open and communicates with the at least one inner outlet orifice;

wherein the inner outlet orifice has an axis which is not parallel to an axis of the dispensing orifice, and wherein the at least one dispensing orifice is oriented along a longitudinal axis of the first element, and the at least one inner outlet orifice is oriented transversely to the longitudinal axis of the first element.

35. The dispensing head of claim 34, wherein the channel passes axially through the first element.

36. The dispensing head of claim 34, wherein the first element is configured to be removably coupled to the actuatable dispensing element.

37. A dispensing head for dispensing a product from a receptacle associated with an actuatable dispensing element, the dispensing head comprising:

a first element defining a channel passing through the first element, the first element further defining at least one inner outlet orifice, located so as to be spaced at a distance from the actuatable dispensing element, the channel being configured to pass product from the actuatable dispensing element to the at least one inner outlet orifice;

a second element defining at least one dispensing orifice, the second element being configured to be displaced relative to the first element from a first position, where actuation of the actuatable dispensing element is prevented and the dispensing orifice is closed by the first element, to a second position, where actuation of the actuatable dispensing element is allowed and the at least one dispensing orifice is at least partly open and communicates with the at least one inner outlet orifice; and a mounting element configured to be fixed to the receptacle;

wherein one of the first element and the mounting element comprises at least one tooth configured to engage at least one groove on the other of the first element and the mounting element so as to rotatably fix the first element relative to the mounting element.

38. The dispensing head of claim 37, wherein the second element comprises an edge substantially in contact with the mounting element when the second element is in the first position on the first element, so as to prevent actuation of the dispensing element.

39. The dispensing head of claim 38, wherein the edge of the second element is an annular edge.

40. The dispensing head of claim 39, wherein the annular edge of the second element is substantially in contact with an annular edge of the mounting element when the second element is in the first position.

41. A dispensing device comprising:

a receptacle;

a product contained in the receptacle;

an actuatable dispensing element associated with the receptacle; and the dispensing head of claim 37.

42. The dispensing device of claim 41, wherein the actuatable dispensing element comprises a valve, the valve comprising a valve body and a valve stem having a portion that emerges outside of a valve body.

43. The dispensing device of claim 42, wherein the first element is removably mounted onto the valve stem.

44. The dispensing device of claim 42, wherein the valve stem projects from the receptacle, so that the first dispensing element is coupled to the valve stem at a region outside of the receptacle.

45. The dispensing device of claim 41, wherein the first element is positioned completely out of the receptacle.

46. The dispensing device of claim 41, wherein the product contained in the receptacle is pressurized.

47. A dispensing head for dispensing a product from a receptacle associated with an actuatable dispensing element, the dispensing head comprising:

a first element defining a channel passing through the first element, the first element further defining at least one inner outlet orifice, located so as to be spaced at a distance from the actuatable dispensing element, the channel being configured to pass product from the actuatable dispensing element to the at least one inner outlet orifice;

a second element defining at least one dispensing orifice, the second element being configured to be displaced relative to the first element from a first position, where actuation of the actuatable dispensing element is prevented and the dispensing orifice is closed by the first element, to a second position, where actuation of the actuatable dispensing element is allowed and the at least one dispensing orifice is at least partly open and communicates with the at least one inner outlet orifice; and means for sealing between the first element and the second element, at least when the second element is in the second position, so as to ensure that all the product exiting from the at least one inner outlet orifice is channeled towards the dispensing orifice.

48. The dispensing head of claim 47, wherein the means for sealing comprises an annular lip having a free edge which, at least when the second element is in the second position, is applied in a sealed manner against an inner annular surface of the second element.

49. The dispensing head of claim 48, wherein the annular lip is elastic.

50. The dispensing head of claim 48, wherein the annular lip is elastically stressed between the first element and the second element when the second element is in the first position.

51. The dispensing head of claim 48, wherein when the second element is in the first position, the free edge bears elastically against the inner surface of an end wall of the second element delimiting said dispensing orifice, said free edge being applied in a sealed manner against the inner surface of a side wall of the second element when the second element is in the second position.

52. A dispensing head for dispensing a product from a receptacle associated with an actuatable valve including a valve stem, the dispensing head comprising:

a first element defining a channel passing through the first element, the first element further defining at least one inner outlet orifice, the channel being configured to pass product from the valve to the at least one inner outlet orifice, the first element being configured to be coupled to the valve stem of the valve at a region located outside of the receptacle; and a second element defining at least one dispensing orifice, the second element being configured to be displaced relative to the first element from a first position, where actuation of the valve is prevented and the dispensing orifice is closed by the first element, to a second position, where actuation of the valve is allowed and the at least one dispensing orifice is at least partly open and communicates with the at least one inner outlet orifice of the first element;

wherein the inner outlet orifice has an axis which is not parallel to an axis of the dispensing orifice, and wherein the at least one dispensing orifice is oriented along a longitudinal axis of the first element, and the at least one inner outlet orifice is oriented transversely to the longitudinal axis of the first element.

53. The dispensing head of claim 52, wherein the channel passes axially through the first element.

54. The dispensing head of claim 52, wherein the first element is configured to be removably coupled to the actuatable dispensing element.

55. The dispensing head of claim 52, further comprising a mounting element configured to be fixed to the receptacle.

* * * * *

UNITED STATES PATENT AND TRADEMARK OFFICE

CERTIFICATE OF CORRECTION

PATENT NO. : 6,827,239 B2
DATED : December 7, 2004
INVENTOR(S) : Pierre-Andre Lasserre et al.

It is certified that error appears in the above-identified patent and that said Letters Patent is hereby corrected as shown below:

Title page,
Item [75], Inventors, "Pierr-André" should read -- Pierre-André --;

Column 9,
Line 45, "actuable dispersing element" should read -- actuatable dispensing element --;
Line 46, "movements" should read -- movement --;

Column 10,
Line 47, "the interact" should read -- to interact --; and

Column 13,
Line 51, "outlet;" should read -- outlet orifice; --.

Signed and Sealed this

Twenty-second Day of March, 2005

JON W. DUDAS
*Director of the United States Patent and Trademark Office*